United States Patent [19]

Sato et al.

[11] 3,984,721

[45] Oct. 5, 1976

[54] COLOR PICK UP TUBE

[75] Inventors: Kazuhiro Sato, Tokyo; Shusaku Nagahara, Kokubunji; Akira Sasano, Kodaira; Takeo Nishimura, Tokyo, all of Japan

[73] Assignees: Hitachi, Ltd.; Hitchi Electronics Ltd., both of Japan

[22] Filed: June 26, 1975

[21] Appl. No.: 590,467

[30] Foreign Application Priority Data

June 26, 1974 Japan ..... 49-72346

[52] U.S. Cl. ..... 313/371; 358/46

[51] Int. Cl.[2] ..... H01J 31/68; H01J 29/89

[58] Field of Search ..... 313/371, 386; 358/46

[56] References Cited

UNITED STATES PATENTS

| | | | |
|---|---|---|---|
| 2,898,489 | 8/1959 | Weimer | 313/371 |
| 3,740,458 | 6/1973 | Kubota | 358/46 |

*Primary Examiner*—Robert Segal

*Attorney, Agent, or Firm*—Craig & Antonelli

[57] ABSTRACT

A color pick up tube having a target structure comprising a transparent substrate a plurality of red, green and blue optical strip filters, each having a width F, mounted interleavely on one surface of the substrate, a thin glass layer, having a thickness T, mounted on the optical strips, a plurality of optically transparent, electrically conductive strips each having a width N, laid down on the thin glass layer such that each conductive strip corresponds to a respectively different optical strip.

In order to prevent optical color cross talk, the widths F, N and the thickness T have the following relationship $$T \leqq \frac{F-N}{2 \tan \theta}$$

where $\theta$ is the incident angle in the glass layer.

3 Claims, 3 Drawing Figures

COLOR PICK UP TUBE

BACKGROUND OF THE INVENTION

1. Field of the Invention

This invention relates to a color pick up tube for use in color television camera devices, in particular to the target structure of a pick up tube used for producing a plurality of color components.

2. Description of the Prior Art

Color television cameras of the single pickup tube type have been proposed utilizing a series of different optical filter strips in a recurring sequence in order to separate the light from a subject image into its color components as imaged upon the pickup tube target.

In this type of color pickup tube, the target structure comprises a transparent substrate or face plate, a plurality of red, green and blue optical filter strips disposed thereon and interleaved in a predetermined sequence, a plurality of optically transparent, electrically conductive strips corresponding to each of the filter strips, a thin glass layer inserted between the optical filter strips and the electrically conductive strips, a substantially continuous layer of photoconductive material covering the conductive strips, and leads or bus bars interconnecting the conductive strips of like color response.

In the above target structure, it is necessary to interpose the thin transparent glass layer between the optical filter strips and the conductive strips (or electrodes) for the manufacture and effective operation of the color pickup tube.

However, including the thin glass layer, poses a serious problem that is a optical color cross talk or undesirable color mixing for the reason given later. This problem has been solved by use of an expensive optical lens system or complicated circuit arrangements in conventional color pickup tubes.

SUMMARY OF THE INVENTION

An object of this invention is to provide an improved color pickup tube producing a plurality of simultaneous component color signals.

Another object of this invention is to provide an improved target structure for use in color pickup tube in which optical cross talk is eliminated.

Still another object of this invention is to provide an economical color pickup tube.

These and other objects are accomplished in accordance with this invention by specifying that the dimension of the width F of the optical filter strips, the width N of the transparent conductive strips, the thickness T of the glass layer inserted between the optical filter strips and the transparent conductive strips, and the incident angle Θ of the light beam in the glass layer have the following relationship $$T \leqq \frac{F-N}{2\tan\theta} \text{ or } N \leqq F - 2T\tan\theta \qquad (1)$$

Other objects and features of this invention will become apparent from the following description in connection with the accompanying drawings.

DESCRIPTION OF THE EMBODIMENTS

Figure 1:
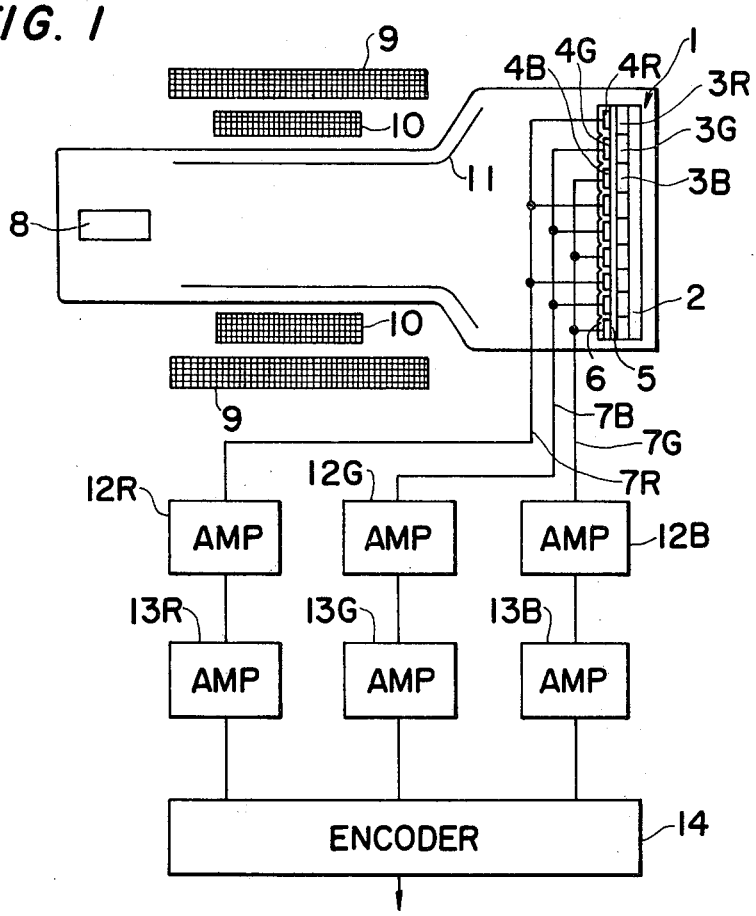
FIG. 1 is a block diagram showing a color television camera pick up tube device to which this invention is applied.
Figure 2:
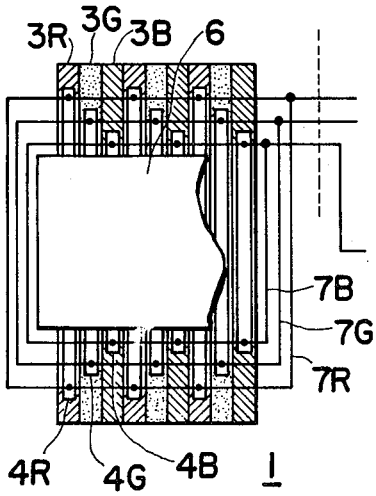
FIG. 2 is a fragmentary plane view of the target shown in FIG. 1.

Referring now to FIG. 1, there is shown a block diagram of a color television camera device to which this invention is applied. The color pickup tube contains a target structure 1 of the previously mentioned photoconductive type, comprising a transparent substrate or face plate 2, interleaved red, green and blue optical filter strips 3R, 3G and 3B, optically transparent and electrically conductive strips 4R, 4G and 4B corresponding to the optical filter strips 3R, 3G and 3B, respectively, a thin glass layer 5, a substantially continuous layer 6 of photoconductive material overlaing the conductive strips, and leads or bus bars 7R, 7G and 7B interconnecting the conductive strips of like color filter association, respectively. A plane view of the target is shown in FIG. 2.

The color pickup tube is also provided with a conventional electron gun 8, which may include the usual cathode, control electrode and one or more electrodes which are connected to operating potential sources in the usual manner. Means are provided for focusing the electron beam developed by the electron gun 8 and for deflecting the beam like/as a conventional scanning raster at the target 1. These means may include a focusing coil 9 and a deflecting yoke 10 and a final accelerating electrode 11, which are coated on the interior envelope of the tube.

The bus bars 7R, 7G and 7B of the target 1 are coupled to pre-amplifiers 12R, 12G and 12B, respectively, each of which amplifies an electrical signal from the target. The outputs of the respective pre-amplifiers are applied to the process amplifiers 13R, 13G and 13B, and are reshaped therein.

Thereafter, the output signals of the process amplifiers are guided to the encoder 14 in which they are composed and transformed into a color television signal such as an NTSC signal. The construction and the operation of the encoder are well known in the art.

On the target structure 1 mentioned above, the thin glass layer has a set thickness of about 5~30 $\mu$m. This fact creates/causes the following problem: optical color cross talk. The reason for such cross talk will be seen from the following description in connection with FIG. 3.

Figure 3:
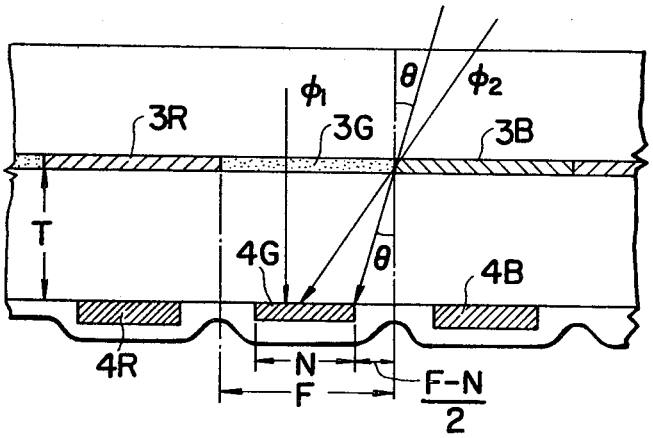
FIG. 3 is an enlarged fragmentary cross sectional view of the target 1 in FIG. 2 for use in explaining the principle of this invention.

As shown in FIG. 3, an incident light beam $\phi$ after passing through one of the optical filter strips 3G, for example, which pass one color component of the light beam, green for example, proceeds to the respective conductive strip 4G, for example. The color component is then converted into a photocurrent, a green color component signal in the above example, for instance. However, if the light beam is inclined as shown by $\phi_2$, an undesirable optical color component filtered by an adjacent optical filter strip 3B, for example, which passes the blue component, may reach the conductive strip 4G which corresponds to the green component. Accordingly, the photocurrent generated by the conductive strip 4G is affected not only by the green component passing through filter 3G, but also by the undesirable blue component passing through filter 3B. In other words, there is generated optical color cross talk.

The incident angle $\theta$ of the color component beam from filters 3R, 3G and 3B to conductive strips 4R, 4G and 4B is determined by the lens (not shown) located in front of the target, the focal distance of the lens and/or the beam impingement position on the target.

This invention has solved the above problem by specifying the dimension of the thickness T of the glass layer 5, the widths F and N of the optical strips and the conductive strips, respectively, according to the above relationship (1).

As shown in FIG. 3 when the values of G and N are determined so as to satisfy a following relationship:

$$N = F - 2 \cdot T \tan \theta \qquad (2)$$

then the color components filtered by the adjacent filter strips 3R and 3B cannot reach the conductive strip 4G corresponding to filter strip 3G. It is apparent that there is no color cross talk in such a case, that is, when the incident angle is smaller than a certain maximum incident angle $\theta$, and when the values of T and N have the above relationship (2).

Furthermore, it is easily shown/verified that there is no color cross talk when the values T and N have the following relationship $$N < F - 2\,T \tan \theta \text{ or } T < \frac{F - N}{2 \tan \theta} \qquad (3)$$

There are numerous types of objective lenses used for television cameras; zoom lenses in particular are popular. In a television camera using a zoom lens, the maximum incident angle of an object light beam to the surface of the target is approximately 18°. An incident light beam impinging on the surface of the substrate is refracted into the substrate medium.

Assuming that the incident angle of an object light beam to the surface of the substrate is 18° and that the refractive indices of the substrate medium and the glass layer are 1.5, then the maximum incident angle $\theta$ of a color component filtered by an optical filter is approximately 12°. Therefore, the above formula (1) may be rewritten as $$T \leqq 2.4\,(F - N) \qquad (4)$$

for, $$\tan \theta = \tan 12° = 0.21$$

One embodiment of the target structure in accordance with this invention is indicated as follows.

The width F of the optical filter strip is 20 $\mu$m, the width N of the conductive strip is 12 $\mu$m. The thickness T of the glass layer is 19.2 $\mu$m. The refractive indices of the substrate medium and the glass layer are 1.5. The maximum incident angle of an object light beam to the surface of the substrate is 18°. In the pickup tube having a target as indicated above there is no color cross talk in the output signal of the pickup tube.

Now, follows the most suitable method for manufacturing the target, in particular, for mounting the glass layer having the desirable thickness T as mentioned above on the optical filter strips.

In the conventional method for forming the glass layer on the optical filter strips, the glass substrate, on one surface of which a plurality of conductive strips are mounted, is first prepared. Secondly, the other surface of the glass substrate is mechanically abraded so as to decrease the thickness of the glass substrate or layer, and finally, the abraded surface is fixed on the opticl filter strips mounted on the other glass substrate using epoxy resin. However this conventional method has several disadvantages. It is very difficult to fabricate a glass layer having a thickness of the order of several microns and that the yield rate of products is no good.

In the new method for forming the glass layer in the above embodiment of the target, the "depositing method" has been used. The depositing method is a method that forms a desirable medium layer by depositing fine particles of suitable material. The methods such as Spattering, Chemical Vapour Deposition, and Vapour Evaporation are known as depositing methods in the field of semiconductor manufacturing.

First of all, a plurality of red, green and blue optical filter strips are interleavely on one surface of a glass substrate in a predetermined sequence by a conventional method such as a photographic process.

Secondly, a thin glass layer is deposited by said depositing method covering the surface of the optical filter strips to a thickness satisfying equation relationship (1) mentioned above.

The thickness is controlled by the depositing time, the temperature, the density of the medium and so on. If the thickness of the glass layer deposited in the second step is greater than the dimension T determined by relationship (1), it is possible to abrade the deposited glass layer in order to reduce its thickness. In this case, the abrasion is much easier than the conventional one for the deposited thin glass layer is fixed to a thick substrate medium.

Thirdly, a plurality of optically transparent, electrically conductive strips each having the width N mentioned above are formed on the thin glass layer in such manner that each of the conductive strips corresponds to one of the optical filter strips.

Finally, a continuous layer of photo-conductive material such as Antimony Sulfide $Sb_2S_3$, Arsenic Selemide $As_2Se_3$, Lead Oxide PhO is overlaid on the conductive strips by a conventional vapor depositing method.

As described above, a pickup tube having a target in connection with this invention has no color cross talk irrespective of the position in the target plane, and it is possible to use an objective lens having a short focusing length without color cross talk. These matters contribute to provide an inexpensive color pickup tube.

We claim:

1. A color pickup tube having a target structure comprising; a transparent substrate, a plurality of red, green and blue optical filter strips each having a width F and each mounted interleavely on one surface of the substrate, a thin glass layer having the thickness of T and being mounted on the optical filter strips, a plurality of optically transparent, electrically conductive strips each having width N and being laid down on the thin glass layer such that each conductive strip corresponds to a respectively different optical fiber filter strips; CHARACTERIZED IN THAT the widths F, N and the thickness T have the following relationship $$T \leqq \frac{F - N}{2 \tan \theta}$$

where $\theta$ is the maximum incident angle of an optical beam to the conductive strips.

2. A color pickup tube according to claim 1; wherein $\theta$ is 12°.

3. A color pickup tube according to claim 1; wherein the glass layer is formed on the optical filter strips by a depositing methode.

* * * * *